US005786118A

United States Patent [19]

Terrell et al.

[11] Patent Number: 5,786,118

[45] Date of Patent: *Jul. 28, 1998

[54] PHOTOCONDUCTIVE RECORDING MATERIAL CONTAINING CROSSLINKED BINDER SYSTEM

[75] Inventors: David Terrell, Lint; Stefaan De Meutter, Antwerp; Marcel Monbaliu, Mortsel, all of Belgium

[73] Assignee: AGFA-Gevaert, N.V., Mortsel, Belgium

[ * ] Notice: The term of this patent shall not extend beyond the expiration date of Pat. No. 5,529,867.

[21] Appl. No.: 716,613

[22] Filed: Sep. 19, 1996

Related U.S. Application Data

[63] Continuation of Ser. No. 335,713, filed as PCT/EP93/01281, May 19, 1993, published as WO93/25939, Dec. 23, 1993, abandoned.

[30] Foreign Application Priority Data

Jun. 4, 1992 [EP] European Pat. Off. ..... 92201611

[51] Int. Cl.[6] ..... G03G 5/05

[52] U.S. Cl. ..... 430/58; 430/59; 430/96

[58] Field of Search ..... 430/58, 59, 96

[56] References Cited

U.S. PATENT DOCUMENTS

| | | | |
|---|---|---|---|
| 3,025,160 | 3/1962 | Bunge et al. . | |
| 4,315,981 | 2/1982 | Wiedemann | 430/59 |
| 5,128,227 | 7/1992 | Monbaliu et al. | 430/59 |
| 5,529,867 | 6/1996 | Terrell et al. | 430/58 |

FOREIGN PATENT DOCUMENTS

| | | | |
|---|---|---|---|
| 4028519 | 3/1991 | Germany | 430/96 |
| 1-94348 | 4/1989 | Japan | 430/58 |
| 2-135453 | 5/1990 | Japan . | |
| 4-123065 | 4/1992 | Japan | 430/96 |

OTHER PUBLICATIONS

Patent & Trademark Office English–Language Translation of Japanese Patent Application 2–135453 (pub May, 1990).

Patent & Trademark Office English–Language Translation of Japanese Patent Application 4–123065 (pub Apr. 1992).

CA 120:324975—Chemical Abstract of JP 53–01939 (Pub Nov. 1993).

Abstract of Japanese Patent 2–135453 pub May 24, 1990.

*Primary Examiner*—Janis L. Dote

*Attorney, Agent, or Firm*—Breiner & Breiner

[57] ABSTRACT

A photoconductive recording material comprising a support and a charge generating layer (CGL) in contiguous relationship with a charge transporting layer (CTL) containing a p-charge transporting material (p-CTM), wherein the binder of said charge generating layer (CGL) has been made insoluble in methylene chloride by crosslinking, and said binder is composed essentially of at least one epoxy resin (1) as defined herein and/or at least one dialkanolamine-modified epoxy resin linked with at least one polyisocyanate.

4 Claims, No Drawings

PHOTOCONDUCTIVE RECORDING MATERIAL CONTAINING CROSSLINKED BINDER SYSTEM

This is a continuation of co-pending application Ser. No. 08/335,713, filed as PCT/EP93/01281, May 19, 1993 published as WO93/25939, Dec. 23, 1993, now abandoned.

DESCRIPTION

The present invention relates to photosensitive recording materials suitable for use in electrophotography.

BACKGROUND OF THE INVENTION

In electrophotography photoconductive materials are used to form a latent electrostatic charge image that is developable with finely divided colouring material, called toner.

The developed image can then be permanently affixed to the photoconductive recording material, e.g. a photoconductive zinc oxide-binder layer, or transferred from the photoconductor layer, e.g. a selenium or selenium alloy layer, onto a receptor material, e.g. plain paper and fixed thereon. In electrophotographic copying and printing systems with toner transfer to a receptor material the photoconductive recording material is reusable. In order to permit rapid multiple printing or copying, a photoconductor layer has to be used that rapidly loses its charge on photo-exposure and also rapidly regains its insulating state after the exposure to receive again a sufficiently high electrostatic charge for a next image formation. The failure of a material to return completely to its relatively insulating state prior to succeeding charging/imaging steps is commonly known in the art as "fatigue".

The fatigue phenomenon has been used as a guide in the selection of commercially useful photoconductive materials, since the fatigue of the photoconductive layer limits the copying rates achievable.

A further important property which determines the suitability of a particular photoconductive material for electrophotographic copying is its photosensitivity, which must be sufficiently high for use in copying apparatuses operating with the fairly low intensity light reflected from the original. Commercial usefulness also requires that the photoconductive layer has a spectral sensitivity that matches the spectral intensity distribution of the light source e.g. a laser or a lamp. This enables, in the case of a white light source, all the colours to be reproduced in balance.

Known photoconductive recording materials exist in different configurations with one or more "active" layers coated on a conducting substrate and include optionally an outermost protective layer. By "active" layer is meant a layer that plays a role in the formation of the electrostatic charge image. Such a layer may be the layer responsible for charge carrier generation, charge carrier transport or both. Such layers may have a homogeneous structure or heterogeneous structure.

Examples of active layers in said photoconductive recording material having a homogeneous structure are layers made of vacuum-deposited photoconductive selenium, doped silicon, selenium alloys and homogeneous photoconducting polymer coatings, e.g. of poly(vinylcarbazole) or polymeric binder(s) molecularly doped with an electron (negative charge carrier) transporting compound or a hole (positive charge carrier) transporting compound such as particular hydrazones, amines and heteroaromatic compounds sensitized by a dissolved dye, so that in said layers both charge carrier generation and charge carrier transport take place.

Examples of active layers in said photoconductive recording material having a heterogeneous structure are layers of one or more photosensitive organic or inorganic charge generating pigment particles dispersed in a polymer binder or polymer binder mixture in the presence optionally of (a) molecularly dispersed charge transport compound(s), so that the recording layer may exhibit only charge carrier generation properties or both charge carrier generation and charge transport properties.

According to an embodiment that may offer photoconductive recording materials with particularly low fatigue a charge generating and charge transporting layer are combined in contiguous relationship. Layers which serve only for the charge transport of charge generated in an adjacent charge generating layer are e.g. plasma-deposited inorganic layers, photoconducting polymer layers, e.g. on the basis of poly(N-vinylcarbazole) or layers made of low molecular weight organic compounds molecularly distributed in a polymer binder or binder mixture.

Useful charge carrier generating pigments (CGM's) belong to one of the following classes:

a) perylimides, e.g. C.I. 71130 (C.I.=Colour Index) described in DBP 2 237 539;

b) polynuclear quinones, e.g. anthanthrones such as C.I. 59 300 described in DBP 2 237 678;

c) quinacridones, e.g. C.I. 46 500 described in DBP 2 237 679;

d) naphthalene 1,4,5,8-tetracarboxylic acid derived pigments including the perinones, e.g. Orange GR, C.I. 71 105 described in DBP 2 239 923;

e) tetrabenzoporphyrins and tetranaphthaloporphyrins, e.g. $H_2$-phthalocyanine in X-crystal form (X-$H_2$Pc) described in U.S. Pat. No. 3,357,989, metal phthalocyanines, e.g. CuPc C.I. 74 160 described in DBP 2 239 924, indium phthalocyanine described in U.S. Pat. No. 4,713,312 and tetrabenzoporphyrins described in EP 428,214A; and naphthalocyanines having siloxy groups bonded to the central metal silicon described in published EP-A 243,205;

f) indigo- and thioindigo dyes, e.g. Pigment Red 88, C.I. 73 312 described in DBP 2 237 680;

g) benzothioxanthene derivatives as described e.g. in Deutsches Auslegungsschrift (DAS) 2 355 075;

h) perylene 3,4,9,10-tetracarboxylic acid derived pigments including condensation products with o-diamines as described e.g. in DAS 2 314 051;

i) polyazo-pigments including bisazo-, trisazo- and tetrakisazo-pigments, e.g. Chlordiane Blue C.I. 21 180 described in DAS 2 635 887, trisazo-pigments, e.g. as described in U.S. Pat. No. 4,990 421 and bisazo-pigments described in Deutsches Offenlegungsschrift (DOS) 2 919 791, DOS 3 026 653 and DOS 3 032 117;

j) squarylium dyes as described e.g. in DAS 2 401 220;

k) polymethine dyes;

l) dyes containing quinazoline groups, e.g. as described in GB-P 1,416,602 according to the following general formula

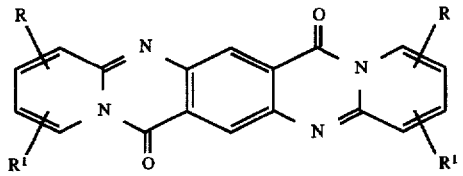

in which R and $R^1$ are either identical or different and denote hydrogen, $C_1$–$C_4$ alkyl, alkoxy, halogen, nitro or hydroxyl or together denote a fused aromatic ring system;

m) triarylmethane dyes; and n) dyes containing 1,5-diamino-anthraquinone groups, o) inorganic photoconducting pigments e.g. Se, Se alloys, $As_2Se_3$, $TiO_2$, ZnO, CdS, etc.

Organic charge carrier transporting substances may be either polymeric or non-polymeric materials.

Examples of preferred polymeric positive hole charge carrier transporting substances are poly (N-vinylcarbazole), N-vinylcarbazole copolymers, polyvinyl anthracene and the condensation products of an aldehyde with two or more 1,2-dihydroquinoline molecules as described in U.S. Pat. No. 5,043,238.

Preferred non-polymeric materials for positive charge transport are:

a) hydrazones e.g. a p-diethylaminobenzaldehyde diphenyl hydrazone as described in U.S. Pat. No. 4,150,987;and other hydrazones described in U.S. Pat. No. 4,423,129; U.S. Pat. No. 4,278,747, U.S. Pat. No. 4,365,014, EP 448,843 A and EP 452,569 A, e.g. T191 from Takasago

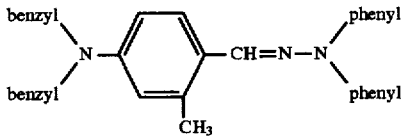

b) aromatic amines e.g. N,N'—diphenyl, N,N-bis-m-tolyl benzidine as described in U.S. Pat. No. 4,265,990, tris(p-tolyl)amine as described in U.S. Pat. No. 3,189,730:

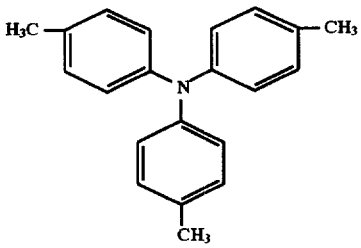

1,3,5-tris(aminophenyl)benzenes as described in U.S. Pat. No. 4,923,774 ; 3,5-diarylaniline derivatives as described in EP 534,514 A, and triphenyloxazole derivatives as described in EP 534,005 A ;

c) heteroaromatic compounds e.g. N—(p-aminophenyl) carbazoles as described in U.S. Pat No. 3,912,509 and dihydroquinoline compounds as described in U.S. Pat. No. 3,832,171, U.S. Pat. No. 3,830,647, U.S. Pat. No. 4,943,502, U.S. Pat. No. 5,043,238, EP 452 569A and EP 462 327A e.g.

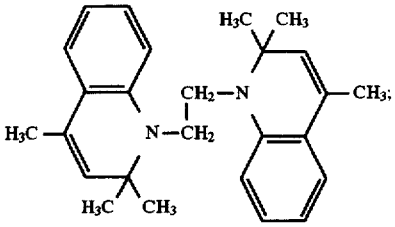

d) triphenylmethane derivatives as described for example in U.S. Pat. No. 4,265,990;

e) pyrazoline derivatives as described for example in U.S. Pat. No. 3,837,851;

f) stilbene derivatives as described for example in Japanese Laid Open Patent Application (JL-OP) 198,043/83.

The choice of binder for the charge generating layer (CGL) for a given charge generating pigment (CGM) and a given charge transport layer (CTL) has a strong influence on the electro-optical properties of the photoreceptors. One or more of the following phenomena can have a negative influence on the electro-optical properties of the photoconductive recording material:

i) interfacial mixing between the CGL and the CTL resulting in CGM-doping of the CTL and CTM-doping of the CGL causing charge trapping;

ii) charge trapping in the CGL;

iii) poor charge transport in the CGL;

iv) poor charge transport blocking properties in the absence of a blocking layer.

Interfacial mixing between the CGL and the CTL can be avoided by using a CGL-binder or binders, which is/are insoluble in the solvent used for dissolving the CTL-binders in which CTM's exhibit optimum charge transport properties is limited as is the range of solvents in which efficient CTM's are soluble. The range of solvents in which both CTL-binders and CTM's are soluble is thus extremely narrow and often limited to chlorohydrocarbons such as methylene chloride. Methylene chloride is an extremely powerful solvent and the range of CGL-binders which is totally insoluble in methylene chloride is extremely limited, unless the CGL-binder is crosslinked in a subsequent hardening process.

Hardening is here considered as a treatment which renders the binder of a charge generating layer of the photoconductive recording material insoluble in methylene chloride.

SUMMARY OF THE INVENTION

It is an object of the present invention to provide a multiple layer photoconductive recording material with improved photosensitivity.

It is a further object of the present invention to provide a photoconductive recording material wherein the interfacial mixing is avoided of a charge transporting layer with a charge generating layer during overcoating of the charge generating layer with a solution of the charge transporting layer ingredients.

It is still a further object of the present invention to provide a said photoconductive recording material wherein the binder system for the charge generating layer allows efficient charge transport in the charge generating layer and efficient charge injection into the charge transporting layer which is a positive charge transporting layer.

In accordance with the present invention a photoconductive recording material is provided comprising a support and a charge generating layer (CGL) in contiguous relationship with a charge transporting layer (CTL) containing a p-charge transporting material (p-CTM), wherein the binder of said charge generating layer (CGL) has been made insoluble in methylene chloride by crosslinking, and said binder is composed essentially of at least one resin (1) and/or at least one resin (2) crosslinked with at least one polyisocyanate, said resin (1) before its crosslinking corresponding to the following general formula (I)

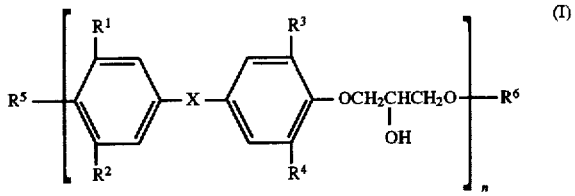

(I)

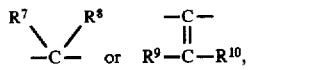

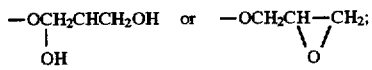

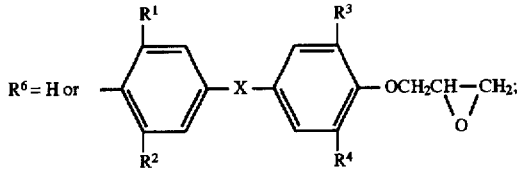

each of $R^7$ and $R^8$ (same or different) represents hydrogen, an alkyl group, an aryl group or together represents the necessary atoms to close a cycloaliphatic ring, e.g. cyclohexane ring, and n is zero or an integer; and said resin (2) before its crosslinking being a dialkanolainine- modified epoxy resin.

DETAILED DESCRIPTION OF THE INVENTION

The polyisocyanate may be set free in the recording layer in situ, e.g. by heat, from a blocked polyisocyanate also called a polyisocyanate precursor.

The synthesis of resin (1) may proceed as described for bisphenol-epichlorhydrin resins (ref. "The Chemistry of Organic Film Formers" by D. H. Solomon, John Wiley & Sons, Inc. New York (1967), p. 179 –189) using as reaction ingredients a bisphenol, e.g. bisphenol A, and epichlorhydrin.

Preferred bisphenol-epichlorhydrin resins are derived from bisphenol A (4,4'-isopropylidenediphenol) and epichlorhydrin.

According to one embodiment a photoconductive recording material of the present invention has a charge generating layer containing as the sole binder one or more of said polyhydroxy resins with the general formula (I) and/or at least one of said dialkanolamine-modified epoxy resins crosslinked with at least one polyisocyanate.

According to another embodiment a photoconductive recording material of the present invention has a charge generating layer containing one or more resins obtained by the crosslinking with said polyisocyanate(s) of (i) polymeric compounds according to said general formula (I) and/or of (ii) at least one said dialkanolamine-modified epoxy resin having a total free HO-group content in an equivalent ratio from 3.0:1 to 1:2.0 with respect to free isocyanate groups of said polyisocyanate(s).

According to a further embodiment a photoconductive recording material according to the present invention has a charge generating layer containing at least 30 wt % of charge generating material(s) (CGM's) and one or more resins with the general formula (I) and/or dialkanolamine-modified epoxy resins hardened with one or more of said polyisocyanates .

Resins according to said general formula (I) are e.g. phenoxy resins of UNION CARBIDE CORP., U.S.A. sold under the following tradenames :

PHENOXY PKHC
PHENOXY PKH
PHENOXY PKHJ and
PHENOXY PKHM-301;

Bisphenol A-epichlorhydrin epoxy resins from SHELL CHEMICAL Co. sold under the following tradenames EPON 1001
EPON 1002
EPON 1004
EPON 1007
EPON 1009
EPONOL Resin 53-BH-35
EPONOL Resin 55-BH-30;

Bisphenol A-epichlorhydrin epoxy resins from DOW CHEMICAL U.S.A. sold under the following tradenames

DER 667
DER 668
DER 669
DER 684- EK40;

Bisphenol A-epichlorhydrin epoxy resins from CIBA-GEIGY AG Switzerland sold under the following tradenames ARALDITE GT 6071
ARALDITE GT7203
ARALDITE GT7097
ARAIDITE GT6099, and ARALDITE GZ488 N40.

Dialkanolamine-modified epoxy resins can be prepared from commercially available epoxy resins with dialkanolamines in the melt or in a solvent mixture under reflux.

(A) In the melt reaction the epoxy resin is heated to its melting point in a vessel equipped with a stirrer and a thermometer and the equivalent amount of dialkanolamine quickly added with stirring. The mixture is further heated at temperatures between 100° C. and 200° C. depending on the chain length of the epoxy resin for two hours with inert gas being bubbled through the reaction mixture. After 2 hours the product is poured out of the vessel, allowed to cool and then broken up into small particles. The reaction is exothermic and cooling is necessary for larger quantities to avoid local overheating.

(B) In the reaction in a solvent mixture a 50 wt % solution of epoxy resin in a mixture of ethylglycol acetate, methylisobutylketone and xylene (2:1:1) is added to a vessel equipped with a reflux condenser, a thermometer and a stirrer. The equivalent amount of dialkanolamine is then added with stirring and the reaction mixture heated to its boiling point. After 2 hours under reflux, the reaction mixture is cooled and a 50 wt % solution of the dialkanolamine-modified epoxy resin obtained.

The polyisocyanates and blocked polyisocyanates used for hardening resins with general formula (I) and dialkanolamine-modified epoxy resins according to the present invention are derived from polyisocyanates or mixtures thereof e.g.

1,6-hexane diisocyanate (HDI);
toluylene diisocyanate (TDI);
diphenylmethane-4,4'-diisocyanate (MDI);
isophorondiisocyanate (IPDI);
triphenylmethane-4,4', 4"triisocyanate
thiophosphoric acid tris(p-isocyanatophenyl ester)

Bayer AG, Germany produces a large variety of polyisocyanates and blocked polyisocyanates under the tradename DESMODUR e.g.

DESMODUR N75, a 75% solution of a biuret HDI,
DESMODUR N100, a biuret HDT;
DESMODUR N3200, a biuret HDI (lower viscosity than DESMODUR N100);
DESMODUR N3300, an HDI isocyanurate;
DESMODUR N3390, a 90% solution of an HDI isocyanurate;
DESMODUR L75, a 75% solution of a TDI-adduct,
DESMODUR IL, a TDI-isocyanurate;
DESMODUR IL 1351, a TDI-polyisocyanate;
DESMODUR HL, a TDI/HDI-polyisocyanate;
DESMODUR VL, a MDI-polyisocyanate;
DESMODUR Z4370, an IPDI-isocyanurate; and blocked polyisocyanates, such as:
DESMODUR BL3175, a blocked HDI-type crosslinking stoving urethane resin; and
DESMODUR BL100, a blocked TDI-type crosslinking stoving urethane resin.

A suitable polyisocyanate precursor, also called a blocked polyisocyanate compound, for use according to the present invention has the following structural formula P:

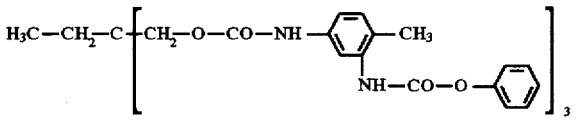

Said polyisocyanate precursor has a good stability at room temperature (20° C.) and generates free polyisocyanate in the temperature range of 100° to 150° C.

The hardening reaction with polyisocyanate taking place in said temperature range is mainly based on the reaction between the isocyanate groups of the thermo-generated polyisocyanate and the free hydroxyl groups of the bisphenol-epoxy type resin, but is also based on the formation of allophanate groups in the reaction of already existing urethane groups of the resin particles with isocyanate groups of the polyisocyanate [ref. D. H. Solomon "The Chemistry of Organic Film Formers"- John Wiley & Sons, Inc. New York , (1967) p. 203].

The resins with general formula (I) and dialkanolamine-modified epoxy resins hardened with polyisocyanates may be used in combination with at least one other polymer serving as binding agent, e.g. in combination with acrylate and methacrylate resins, copolyesters of a diol, e.g. glycol, with isophthalic and/or terephthalic acid, polyacetals, polyurethanes, polyester-urethanes, aromatic polycarbonates, wherein a preferred combination contains at least 50% by weight of said resins with general formula (I) and/or dialkanolamine-modified epoxy resins hardened with polyisocyanates or blocked polyisocyanates in the total binder content.

A polyester resin particularly suitable for use in combination with said crosslinked resins is DYNAPOL L 206 (registered trade mark of Dynamit Nobel) for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of the recording material.

Aromatic polycarbonates that are suitable for use in admixture with said crosslinked resins can be prepared by methods such as those described by D. Freitag, U. Grigo, P. R. Müller and W. Nouvertnéin the. Encyclopedia of Polymer Science and Engineering, 2nd ed., Vol. II, pages 648–718, (1988) published by Wiley and Sons Inc., and have one or more repeating units within the scope of following general formula:

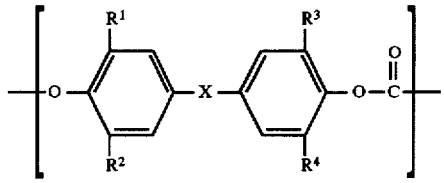

wherein : X, $R^1$, $R^2$, $R^3$ and $R^4$ have the same meaning as described in general formula (I) above.

Aromatic polycarbonates having a molecular weight in the range of 10,000 to 200,000 are preferred. Suitable polycarbonates having such a high molecular weight are sold under the registered trade mark MAKROLON of Bayer AG, W-Germany.

MAKROLON CD 2000 (registered trade mark) is a bisphenol A polycarbonate with molecular weight in the range of 12,000 to 25,000 wherein $R^1=R^2=R^3=R^4=H$, X is

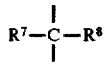

with $R^7=R^8=CH_3$.

MAKROLON 5700 (registered trade mark) is a bisphenol A polycarbonate with molecular weight in the range of 50,000 to 120,000 wherein $R^1=R^2=R^3=R^4=H$, X is

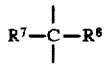

with R7=R8=$CH_3$.

Bisphenol Z polycarbonate is an aromatic polycarbonate containing recurring units wherein $R^1=R^2=R^3=R^4=H$, X is

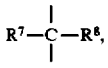

and $R^7$ together with $R^8$ represents the necessary atoms to close a cyclohexane ring.

Suitable electronically inactive binder resins for use in active layers of the present photoconductive recording material not containing said resins hardened with polyisocyanates are e.g. the above mentioned polyester and polycarbonates, but also cellulose esters, acrylate and methacrylate resins, e.g. cyanoacrylate resins, polyvinyl chloride, copolymers of vinyl chloride, e.g. copolyvinyl chloride/acetate and copolyvinyl chloride/maleic anhydride.

Further useful binder resins for an active layer are silicone resins, polystyrene and copolymers of styrene and maleic anhydride and copolymers of butadiene and styrene.

Charge transport layers in the photoconductors of the present invention preferably have a thickness in the range of 5 to 50 μm, more preferably in range of 5 to 30 μm. If these layers contain low molecular weight charge transport molecules, such compounds will preferably be present in concentrations of 30 to 70% by weight.

The presence of one or more spectral sensitizing agents can have an advantageous effect on the charge transport. In that connection reference is made to the methine dyes and xanthene dyes described in U.S. Pat. No. 3,832,171. Preferably these dyes are used in an amount not substantially reducing the transparency in the visible light region (420–750 nm) of the charge transporting layer so that the charge generating layer still can receive a substantial amount of the exposure light when exposed through the charge transporting layer.

The charge transporting layer may contain compounds substituted with electron-acceptor groups forming an intermolecular charge transfer complex, i.e. donor-acceptor complex when electron donor charge transport compounds are present. Useful compounds having electron-accepting groups are nitrocellulose and aromatic nitro-compounds such as nitrated fluorenone-9 derivatives, nitrated 9-dicyanomethylene fluorenone derivatives, nitrated naphthalenes and nitrated naphthalic acid anhydrides or imide derivatives. The preferred concentration range of said compounds having electron acceptor groups is such that the donor/acceptor weight ratio is 2.5:1 to 1,000:1.

Compounds acting as stabilising agents against deterioration by ultra-violet radiation, so-called UV-stabilizers, may also be incorporated in said charge transport layer. Examples of UV-stabilizers are benztriazoles.

For controlling the viscosity and aiding deaeration of the coating compositions and controlling their optical clarity silicone oils may be added to the charge transport layer.

As charge generating compounds for use in a recording material according to the present invention any of the organic pigments belonging to one of the following classes and able to transfer electrons to electron transporting materials may be used :

a) perylimides, e.g. C.I. 71 130 (C.I. =Colour Index) described in DBP 2,237,539, b) polynuclear quinones, e.g. anthanthrones such as C.I. 59 300 described in DBP 2,237,678, c) quinacridones, e.g. C.I. 46 500 described in DBP 2,237,679, d) naphthalene 1,4,5,8-tetracarboxylic acid derived pigments including the perinones, e.g. Orange GR, C.I. 71 105 described in DBP 2,239,923, e) tetrabenzoporphyrins and tetranaphthaloporphyrins, e.g.

$H_2$-phthalocyanine in X-crystal form (X-$H_2$Pc) described in U.S. Pat. No. 3,357,989, metal phthalocyanines, e.g. CuPc C.I. 74 160 described in DBP 2,239,924, indium phthalocyanine described in U.S. Pat. No. 4,713,312, tetrabenzoporphyrins described in EP 428,214A, silicon naphthalocyanines having siloxy groups bonded to the central silicon as described in EP-A 0243205 and X- and β-morphology form $H_2Pc(CN)x$, $H_2Pc(CH_3)x$ and $H_2PcCl$ f) indigo- and thioindigo dyes, e.g. Pigment Red 88, C.I. 73 312 described in DBP 2,237,680, g) benzothioxanthene-derivatives as described e.g. in DAS 2,355,075, h) perylene 3,4,9,10-tetracarboxylic acid derived pigments including condensation products with o-diamines as described e.g. in DAS 2,314,051, i) polyazo-pigments including bisazo-, trisazo- and tetrakisazo-pigments, e.g. Chlordiane Blue C.I. 21 180 described in DAS 2,635,887, and bisazopigments described in DOS 2,919,791, DOS 3,026,653 and DOS 3,032,117, j) squarilium dyes as described e.g. in DAS 2,401,220, k) polymethine dyes, l) dyes containing quinazoline groups, e.g. as described in GB-P 1,416,602 according to the following general formula:

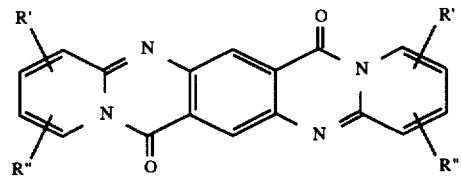

wherein R' and R" have the meaning described in said GB-P document.

Inorganic substances suited for photogenerating negative charges in a recording material according to the present invention are e.g. amorphous selenium and selenium alloys e.g. selenium-tellurium, selenium-tellurium-arsenic and selenium-arsenic and inorganic photoconductive crystalline compounds such as cadmium sulphoselenide, cadmiumselenide, cadmium sulphide and mixtures thereof as disclosed in U.S. Pat. No. 4,140,529.

The thickness of the charge generating layer is preferably not more than 10 μm, more preferably not more than 5 μm.

In the recording materials of the present invention an adhesive layer or barrier layer may be present between the charge generating layer and the support or the charge transport layer and the support. Useful for that purpose are e.g. a polyamide layer, nitrocellulose layer, hydrolysed silane layer, or aluminium oxide layer acting as a blocking layer preventing positive or negative charge injection from the support side. The thickness of said barrier layer is preferably not more than 1 micron.

The conductive support may be made of any suitable conductive material. Typical conductors include aluminum, steel, brass and paper and resin materials incorporating or coated with conductivity enhancing substances. An insulating support such as a resin support is e.g. provided with a conductive coating e.g. vacuum-deposited metal such as aluminium, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

According to a particular embodiment the support is an insulating resin support provided with an aluminium layer forming a conductive coating.

The support may be in the form of a foil, web or be part of a drum.

An electrophotographic recording process according to the present invention comprises the steps of:

(1) overall electrostatically charging, e.g. with corona-device, the photoconductive layer containing at least one resin according to general formula (I) and/or alkanolamine-modified epoxy resins hardened with at least one polyisocyanate or blocked polyisocyanate;

(2) image-wise photo-exposing said layer thereby obtaining a latent electrostatic image, that may be toner-developed.

When applying a bilayer-system electrophotographic recording material including on an electrically conductive support a photosensitive charge generating layer that contains one or more resins according to general formula (I) and/or alkanolamine-modified epoxy resins hardened with one or more polyisocyanates or blocked polyisocyanates in contiguous relationship with a charge transporting layer, the photo-exposure of the charge generating layer proceeds preferably through the charge transporting layer but may be direct if the charge generating layer is uppermost or may proceed likewise through the conductive support if the latter is transparent enough to the exposure light.

The development of the latent electrostatic image commonly occurs preferably with finely divided electrostatically attractable material, called toner particles that are attracted by coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref. : R. M. Schaffert "Electrophotography"—The Focal Press—London, New York, enlarged and revised edition 1975, p. 50–51 and T. P. Maclean "Electronic Imaging" Academic Press—London, 1979, p. 231).

According to a particular embodiment electrostatic charging, e.g. by corona, and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the charge generating layer may be used in combination with all kinds of photon-radiation, e.g. light of the visible spectrum, infra-red light, near ultra-violet light and likewise X-rays when electron-positive hole pairs can be formed by said radiation in the charge generating layer. Thus, they can be used in combination with incandescent lamps, fluorescent lamps, laser light sources or light emitting diodes by proper choice of the spectral sensitivity of the charge generating substance or mixtures thereof.

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

The following examples further illustrate the present invention. All parts, ratios and percentages are by weight unless otherwise stated.

The evaluations of electrophotographic properties determined on the recording materials of the following examples relate to the performance of the recording materials in an electrophotographic process with a reusable photoreceptor. The measurements of the performance characteristics were carried out by using a sensitometric measurement in which the discharge was obtained for 16 different exposures in addition to zero exposure. The photoconductive recording sheet material was mounted with its conductive backing on an aluminium drum which was earthed and rotated at a circumferential speed of 10 cm/s. The recording material was sequentially charged with a negative corona at a voltage of −5.7 kV operating with a grid voltae of −600 V. Subsequently the recording material was exposed (simulating image-wise exposure) with a light dose of monochromatic light obtained from a monochromator positioned at the circumference of the drum at an angle of 45° with respect to the corona source. The photo-exposure lasted 200 ms. Thereupon, the exposed recording material passed an electrometer probe positioned at an angle of 180° with respect to the corona source. After effecting an overall post-exposure with a halogen lamp producing 355 mJ/m2 positioned at an angle of 270° with respect to the corona source a new copying cycle started. Each measurement relates to 80 copying cycles in which the photoconductor is exposed to the full light source intensity for the first 5 cycles, then sequentially to the light source the light output of which is moderated by grey filters of optical densities 0.2, 0.38, 0.55, 0.73, 0.92, 1.02, 1.20, 1.45, 1.56, 1.70, 1.95, 2.16, 2.25, 2.51 and 3.21, each for 5 cycles and finally to zero light intensity for the last 5 cycles.

The electro-optical results quoted in the EXAMPLES 1 to 43 and COMPARATIVE EXAMPLES 1 to 3 hereinafter refer to charging level at zero light intensity (CL) and to discharge at a light intensity corresponding to the light source intensity moderated by a grey filter to the exposure indicated to a residual potential RP.

The % discharge is:

$$\frac{(CL - RP)}{CL} \times 100$$

For a given corona voltage, corona grid voltage, separating distance of the corona wires to recording surface and drum circumferential speed the charging level CL is only dependent upon the thickness of the charge transport layer and its specific resistivity. In practice CL expressed in volts should be preferably ≧30 d, where d is the thickness in Lm of the charge transport layer.

The structures of the p-CTM's used in the examples (P1 to P6) are given below:

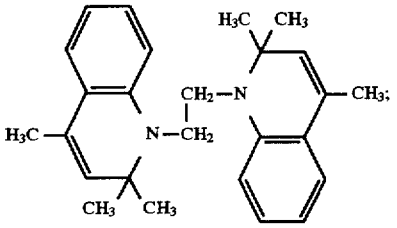
(P1)
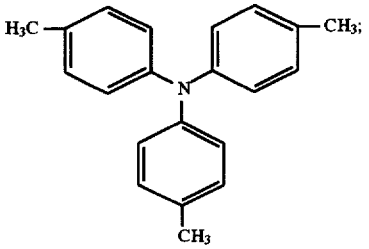
(P2)
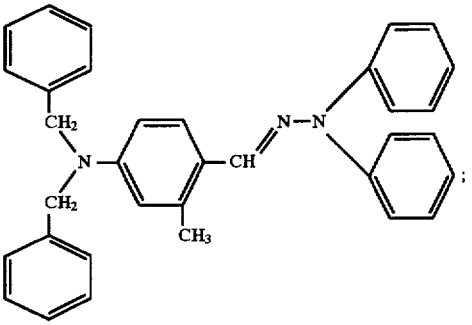
(P3)
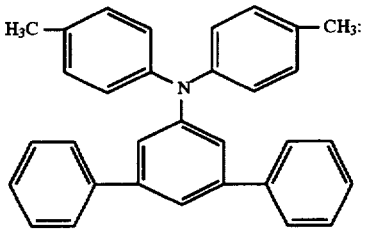
(P4)
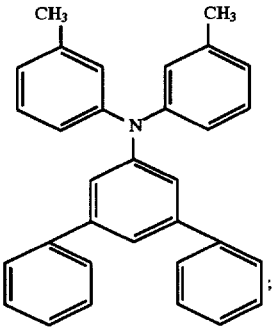
(P5)

-continued (P6)

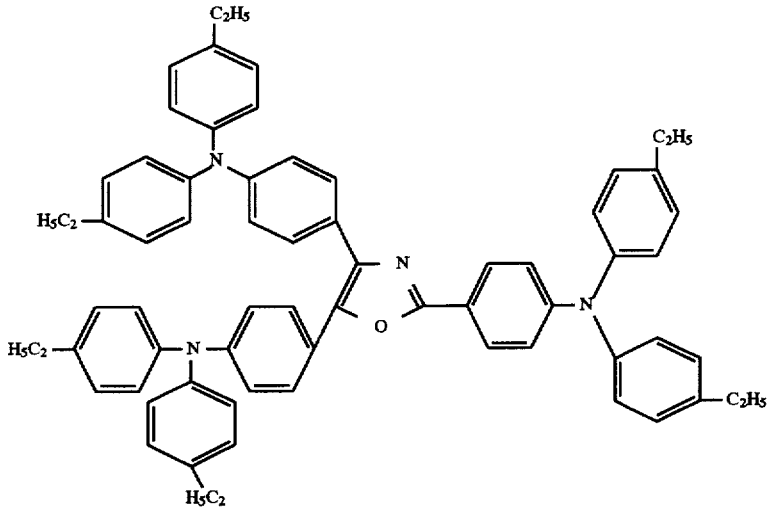

All ratios and percentages mentioned in the Examples are by weight.

EXAMPLE 1

In the production of a composite layer electrophotographic recording material a 175 μm thick polyester film pre-coated with a vacuum-deposited layer of aluminium was doctor-blade coated with a dispersion of charge generating pigment to a thickness of 0.9 μm.

Said dispersion was prepared by mixing 2 g of metal-free X-phthalocyanine (FASTOGEN BLUE 8120B tradename from Dainippon Ink and Chemicals Inc.); 0.3 g of PHENOXY PKHH (tradename for a bisphenol A-epichlorhydrin phenoxy resin from Union Carbide); and 26.45 g of methylene chloride for 40 hours in a ball mill. 0.88 g of PHENOXY PKHH (tradename), 9.36 g of butan-2-one, 26.58 g of methylene chloride and 1.09 g of DESMODUR N75 (tradename for a a 75% solution of a hexamethylene diisocyanate-type hardener in 1:1 xylene:1-methoxypropylacetate-2 from Bayer AG.), were then added to the dispersion and the dispersion mixed for a further 15 minutes.

The applied layer was dried and thermally hardened for 2 hours at 100° C. and then overcoated using a doctor-blade coater with a filtered solution consisting of 3 g of the CTM P1; 3 g of MAKROLON 5700 (tradename for a bisphenol A polycarbonate from Bayer AG); and 44 g of methylene chloride to a dried thickness of 14.1 μm. This layer was dried at 50° C. for 16 hours.

The electro-optical characteristics of the thus obtained photoconductive recording materials were determined as described above. At a charging level of −516 V and an exposure $I_{660}t$ of 10 mJ/m$^2$, the following results were obtained:

CL=−516 V
RP=−73 V
% Discharge=85.9

EXAMPLES 2 AND 3 AND COMPARATIVE EXAMPLE 1

The photoconductive recording materials of examples 2 and 3 and comparative example 1 were produced as described for example 1 except that alternative hardeners were used in the materials of examples 2 and 3 and no hardener was used for the material of comparative example 1 and the amounts of PHENOXY PKHH (tradename) and hardener were adjusted to obtain a theoretical degree of hardening of 100%. The weight percentages of the PHENOXY PKHH (tradename) and hardener in the CGL's calculated on the basis of the solids content of the hardener are given in Table 1 together with the CTL layer thicknesses.

The electro-optical characteristics of the thus obtained photoconductive recording materials were determined as described above and the results summarized in Table 1 together with those for the photoconductive recording material of example 1. From this table it is evident that hardening of PHENOXY PKHH (tradename) with DESMODUR N75, N100 or N3200 (tradenames) produces a significant improvement in the electro-optical properties of the photosensitive recording material as can be learned from the increase in % discharge.

TABLE 1

| | PHENOXY PKHH | | Hardener | $I_{660}t$ = 10 mJ/m$^2$ | | | |
|---|---|---|---|---|---|---|---|
| | conc. [wt %] | Hardener (tradenames) | conc. [wt %] | $d_{CTL}$ [μm] | CL [V] | RP [V] | % Discharge |
| Example No. | | | | | | | |
| 1 | 29.51 | DESMODUR N75 | 20.49 | 14.1 | −516 | −73 | 85.9 |
| 2 | 29.51 | DESMODUR N100 | 20.49 | 12.1 | −537 | −83 | 84.5 |

TABLE 1-continued

| | PHENOXY PKHH | | Hardener | $I_{660}t$ = 10 mJ/m² | | | |
|---|---|---|---|---|---|---|---|
| | conc. [wt %] | Hardener (tradenames) | conc. [wt %] | $d_{CTL}$ [μm] | CL [V] | RP [V] | % Discharge |
| 3 | 30.38 | DESMODUR N3200 | 19.62 | 13.1 | −539 | −74 | 86.3 |
| Comparative Example No. | | | | | | | |
| 1 | 50 | — | — | 14.1 | −540 | −103 | 80.9 |

EXAMPLES 4 TO 9 AND COMPARATIVE EXAMPLE 2

The photoconductive recording materials of examples 4 to 10 and comparative example 2 were produced as described for example 1 except that DER 684 EK40 (tradename for a high molecular weight bisphenol A-epichlorhydrin epoxy resin from Dow Chemical), was used instead of PHENOXY PKHH (tradename) with different polyisocyanate hardeners except in the case of comparative example 2 for which no hardener was used. The amounts of DER 684 EK40 (tradename) and hardener were adjusted to obtain a theoretical degree of hardening 100%. The weight percentages of the DER 684 EK40 (tradename) hardener in the CGL's calculated on the basis of the solids content of the hardener are given in Table 2 together with the CTL layer thicknesses.

The electro-optical characteristics of the thus obtained photoconductive recording materials were determined as described above and the results summarized in Table 2. From this table it is evident that hardening of DER684 EK40 (tradename) with DESMODUR N75, N100, N3200, VL and Z4370 (tradenames) produces a significant improvement in the electro-optical properties of the photosensitive recording material as can be seen from the increase in % discharge.

EXAMPLES 10 TO 16 AND COMPARATIVE EXAMPLE 3

The photoconductive recording materials of examples 11 to 16 and comparative example 3 were produced as described for example 1 except that EPON 1009 (tradename for a bisphenol A-epichlorhydrin epoxy resin from Shell Chemical Co., was used instead of PHENOXY PKHH (tradename) with different polyisocyanate hardeners and no hardener in the case of comparative example 3 and in the case of example 15 a hardening temperature of 150° C. was used instead of 100° C. The amounts of EPON 1009 (tradename) and hardener were adjusted to obtain a theoretical degree of hardening of 100%. The weight percentages of the EPON 1009 (tradename) and hardener in the CGL'calculated on the basis of the solids content of the hardener are given in Table 3 together with the CTL layer thicknesses.

The electro-optical characteristics of the thus obtained photoconductive recording materials were determined as described above and the results are summarized in Table 3. From this table it is evident that hardening of EPON 1009 (tradename) with DESMODUR N75, N100, N3200, BL3175 and L75 (tradenames) produces a significant improvement in the electro-optical properties of the photosensitive recording material as can be seen from the increase in % discharge.

TABLE 2

| | DER 684 -EK 40 | | Hardener | $I_{660}t$ = mJ/m² | | | |
|---|---|---|---|---|---|---|---|
| | conc. [wt %] | Hardener (tradenames) | conc. [wt %] | $d_{CTL}$ [μm] | CL [V] | RP [V] | % Discharge |
| Example No. | | | | | | | |
| 4 | 30.35 | DESMODUR N75 | 19.65 | 14.1 | −534 | −94 | 82.4 |
| 5 | 30.35 | DESMODUR N100 | 19.65 | 15.1 | −530 | −91 | 82.8 |
| 6 | 30.86 | DESMODUR N3200 | 19.14 | 13.1 | −537 | −90 | 83.2 |
| 7 | 30.10 | DESMODUR N3300 | 19.90 | 14.1 | −553 | −127 | 77.0 |
| 8 | 34.22 | DESMODUR VL | 15.78 | 14.1 | −487 | −88 | 81.9 |
| 9 | 26.82 | DESMODUR Z4370 | 23.18 | 15.1 | −557 | −108 | 80.6 |
| Comparative Example No. | | | | | | | |
| 2 | 50 | — | none | 13.1 | −593 | −145 | 75.5 |

TABLE 3

| | EPON 1009 | | Hardener | | | $I_{660}t = 10$ mJ/m² | | |
|---|---|---|---|---|---|---|---|---|
| | conc. [wt %] | Hardener (tradenames) | conc. [wt %] | $d_{CTL}$ [μm] | CL [V] | RP [V] | % Discharge |
| Example No. | | | | | | | |
| 10 | 27.97 | DESMODUR N75 | 22.03 | 12.1 | −526 | −71 | 86.5 |
| 11 | 27.97 | DESMODUR N100 | 22.03 | 11.1 | −535 | −77 | 85.6 |
| 12 | 28.87 | DESMODUR N3200 | 21.13 | 12.1 | −524 | −74 | 85.9 |
| 13 | 28.09 | DESMODUR N3300 | 21.91 | 13.1 | −508 | −94 | 81.5 |
| 14 | 23.45 | DESMODUR BL3175 | 26.55 | 16.1 | −530 | −103 | 80.6 |
| 15 | 25.41 | DESMODUR L75 | 24.59 | 12.1 | −495 | −91 | 81.6 |
| Comparative Example No. | | | | | | | |
| 3 | 50 | — | — | 15.1 | −570 | −128 | 77.5 |

EXAMPLES 16 TO 27

The photoconductive recording materials of examples 16 to 27 were produced as described for example 1 except that different bisphenol A epichlorhydrin epoxy resins from different suppliers with different epoxy equivalent weights were used instead of PHENOXY PKHH. The amounts of epoxy resin and DESMODUR N75 were adjusted to obtain a theoretical degree of hardening of 100%. The weight percentages of epoxy resin and DESMODUR N75 calculated on the basis of the solids content of DESMODUR N75 are given in Table 4 together the CTL layer thicknesses.

The electro-optical characteristics of the thus obtained photoconductive recording materials were determined as described above and the results are summarized in Table 4 together with those for the photoconductive recording materials of examples 10 and 4.

EXAMPLES 28 AND 29

The photoconductive recording materials of examples 28 and 29 were produced as described for example 1 except that diethanolamine-modified ARALDITE GT 6071 (tradename) and diethanolamine-modified ARALDITE GT 6099 (tradename) were used as hydroxy group-containing resins instead of PHENOXY PKHH (tradename). The amounts of resin and DESMODUR N75 (tradename) were adjusted to obtain a theoretical degree of hardening of 100%. The weight percentages of the resins and DESMODUR N75 (tradename) in the CGL's calculated on the basis of the solids content of the hardener are given in Table 5 together with the CTL layer thicknesses.

The electro-optical characteristics of the thus obtained photoconductive recording materials were determined as described above and the results are summarized in Table 5.

TABLE 4

| | | Epoxy resin | DESMODUR N75 | | $I_{660}t = 10$ mJ/m² | | |
|---|---|---|---|---|---|---|---|
| Example No. | Epoxy resin | conc. [wt %] | conc. [wt %] | $d_{CTL}$ [μm] | CL [V] | RP [V] | % Discharge |
| 16 | ARALDITE GT6071* | 35.35 | 14.65 | 13.1 | −558 | −96 | 82.8 |
| 17 | EPON 1001+ | 30.05 | 19.95 | 12.1 | −576 | −112 | 80.6 |
| 18 | ARALDITE GT7203* | 26.55 | 23.45 | 15.1 | −587 | −84 | 85.7 |
| 19 | EPON 1002+ | 31.4 | 18.6 | 10.1 | −541 | −109 | 79.9 |
| 20 | EPON 1004+ | 30 | 20 | 14.1 | −570 | −106 | 81.4 |
| 21 | ARALDITE GT7097* | 23.55 | 26.45 | 14.1 | −562 | −78 | 86.1 |
| 22 | EPON 1007+ | 29.19 | 20.81 | 12.1 | −568 | −100 | 82.4 |
| 23 | DER 667° | 31.03 | 18.97 | 13.1 | −517 | −84 | 83.8 |
| 24 | ARALDITE GT6099* | 30.31 | 19.69 | 13.1 | −521 | −84 | 83.9 |
| 25 | DER 668° | 30.31 | 19.69 | 12.1 | −522 | −83 | 84.1 |
| 10 | EPON 1009+ | 27.97 | 22.03 | 12.1 | −526 | −71 | 86.5 |
| 26 | DER 669° | 29.63 | 20.37 | 13.1 | −519 | −85 | 83.6 |
| 4 | DER 684-EK40° | 30.35 | 19.65 | 14.1 | −534 | −94 | 82.4 |
| 27 | ARALDITE GZ488 N40-1* | 28.35 | 21.65 | 13.1 | −551 | −82 | 85.1 |

*from Ciba Geigy AG
+from Shell Chemical Co.
°from Dow Chemical

TABLE 5

| Example No. | Resin | Resin conc. [wt %] | DESMODUR N75 conc. [wt %] | $d_{CTL}$ [μm] | $I_{650}t = 10$ mJ/m² CL [V] | RP [V] | % Discharge |
|---|---|---|---|---|---|---|---|
| 28 | Diethanolamine-modified ARALDITE GT 6071 | 17.73 | 32.27 | 14.1 | −560 | −111 | 80.2 |
| 29 | Diethanolamine-modified ARALDITE GT 6099 | 23.32 | 26.68 | 12.1 | −605 | −187 | 69.1 |

EXAMPLES 30 TO 33

The photoconductive recording materials of examples 31 to 34 were produced as described in example 19 except that the amounts of ARALDITE GT7203 (tradename) and DESMODUR N75 (tradename) were adjusted to obtain various theoretical degrees of hardening, as indicated in Table 6. The weight percentages of ARALDITE GT7203 (tradename) and DESMODUR N75 (tradename) calculated on the basis of the solids contents of the reactants are given in Table 6 together with the CTL layer thicknesses.

The electro-optical properties of the thus obtained photoconductive recording materials were determined as described above and the results are summarized in Table 6.

TABLE 6

| Example No. | ARALDITE GT7203 conc. [wt %] | DESMODUR N75 conc. [wt %] | Theoretical degree of hardening [%] | $I_{650}t = 10$ mJ/m² $d_{CTL}$ [μm] | CL [V] | RP [V] | % Discharge |
|---|---|---|---|---|---|---|---|
| 30 | 34.3 | 15.7 | 150 | 15.1 | −578 | −101 | 82.5 |
| 31 | 38.3 | 11.7 | 100 | 14.1 | −582 | −97 | 83.3 |
| 32 | 40.55 | 9.45 | 75 | 14.1 | −587 | −107 | 81.8 |
| 33 | 43.35 | 6.65 | 50 | 14.1 | −582 | −114 | 80.4 |

EXAMPLES 34 TO 39

The photoconductive recording materials of examples 34 to 39 were produced as described for example 10 except that different CTM's were used in the charge transport layer. The CTM's used together with the CTM concentrations used in the CTL and the CTL layer thicknesses are given in Table 7.

The electro-optical characteristics of the thus obtained photoconductive recording materials were determined as described above and the results are summarized in Table 7 below.

TABLE 7

| Example No. | CTM | CTM conc. | $d_{CTL}$ | $I_{650}t = 10$ mJ/m² CL | RP | % discharge |
|---|---|---|---|---|---|---|
| 34 | P1 | 50 | 12.1 | −582 | −82 | 85.9 |
| 35 | P2 | 40 | 11.1 | −585 | −70 | 88.0 |
| 36 | P3 | 50 | 11.1 | −558 | −125 | 77.6 |
| 37 | P4 | 50 | 12.1 | −573 | −76 | 86.7 |
| 38 | P5 | 50 | 11.1 | −579 | −91 | 84.3 |
| 39 | P6 | 50 | 13.1 | −524 | −36 | 93.1 |

EXAMPLES 40 TO 43

The photoconductive recording materials of examples 40 to 43 were produced as described in example 1 except that various CGM's with different grinding times were used. The CGM's and grinding times used together with the CTL layer thicknesses are summarized in table 8.

The characteristics of the thus obtained photoconductive recording materials were determined as described above and are given in table 8.

TABLE 8

| Example No. | CGM No. | CGM conc. [wt %] | Grinding time [h] | $d_{CTL}$ [μm] | [nm] | $I_s = 10$ mJ/m² CL [V] | RP [V] | % discharge |
|---|---|---|---|---|---|---|---|---|
| 40 | CGM 1* | 50 | 40 | 15.1 | 660 | −530 | −85 | 84.0 |
| 41 | CGM 2⁺ | 50 | 40 | 13.1 | 660 | −584 | −81 | 86.1 |
| 42 | CGM 30° | 50 | 72 | 15.1 | 660 | −287 | −123 | 57.1 |
| 43 | CGM 4* | 50 | 24 | 14.1 | 540 | −615 | −378 | 38.5 |

*CGM 1 = metal-free X-phthalocyanine (FASTOGEN Blue 8120B from Dainippon Ink and Chemicals Inc.)

⁺CGM 2 = a mixed crystalline pigment with an X-morphology consisting of a 1.75:1 molar mixture of metal-free 1-cyano phthalocyanine to unsubstited metal-free phthalocyanine °CGM 3 = metal-free ω-triazotetrabenzoporphyrin

*CGM 4 = 4,10-dibromoanthanthrone (ICI).

We claim:

1. A photoconductive recording material comprising a support and a charge generating layer (CGL) in contiguous relationship with a charge transporting layer (CTL) containing a p-charge transporting material (p-CTM), said charge generating layer (CGL) comprising a charge generating material and a binder, wherein said binder has been made insoluble in methylene chloride by crosslinking and consists essentially of at least one resin (1) crosslinked with at least one polyisocyanate, said resin (1) before its crosslinking corresponding to the following general formula (I):

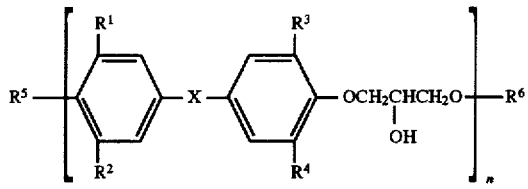

(I)

in which: X represents —S—, —$SO_2$—,

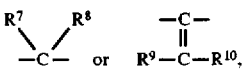

each of $R^1$, $R^2$, $R^3$, $R^4$, $R^9$ and $R^{10}$ (same or different) represents hydrogen, halogen, an alkyl group or an aryl group; $R^5$ is —OH,

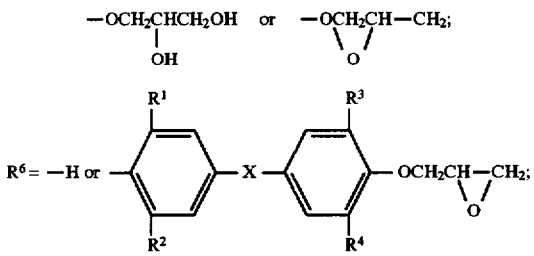

each of $R^7$ and $R^8$ (same or different) represents hydrogen, an alkyl group, an aryl group or represents the necessary atoms to complete, together with the carbon atom to which they are attached, a cycloaliphatic ring, and n is zero or an integer;

wherein the ratio of total free hydroxy-groups in said resin(s) according to formula (I), expressed as hydroxy-equivalents, to the total isocyanate equivalents in said polyisocyanates is in the range 3.0:1 to 1:2.0, said binder in said charge generating layer including another polymer.

2. Photoconductive recording material according to claim 1, wherein said other polymer is selected from the group consisting of an acrylate resin, methacrylate resin, copolyester of a diol with isophthalic and/or terephthalic acid, polyacetal, polyurethane, polyester-urethane and aromatic polycarbonate.

3. A photoconductive recording material comprising a support and a charge generating layer (CGL) in contiguous relationship with a charge transporting layer (CTL) containing a p-charge transporting material (p-CTM), said charge generating layer (CGL) comprising a charge generating material and a binder, wherein said binder has been made insoluble in methylene chloride by crosslinking and consists essentially of at least one resin (2) crosslinked with at least one polyisocyanate, said resin (2) before its crosslinking being an epoxy resin that has undergone a reaction with a dialkanolamine, wherein the ratio of total free hydroxy-groups in said epoxy resins, expressed as hydroxy equivalents, that has undergone a reaction with a dialkanolamine to isocyanate equivalents in said polyisocyanates is in the range 3.0:1 to 1:2.0.

4. A photoconductive recording material comprising a support and a charge generating layer (CGL) in contiguous relationship with a charge transporting layer (CTL) containing a p-charge transporting material (p-CTM), said charge generating layer (CGL) comprising a charge generating material and a binder, wherein said binder has been made insoluble in methylene chloride by crosslinking and consists essentially of at least one resin (1) and at least one resin (2) crosslinked with at least one polyisocyanate, said resin (1) before its crosslinking corresponding to the following general formula (I):

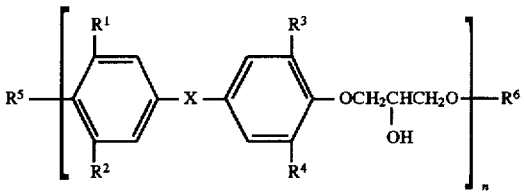

(I)

in which: X represents —S—, —$SO_2$—,

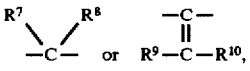

each of $R^1$, $R^2$, $R^3$, $R^4$, $R^9$ and $R^{10}$ (same or different) represents hydrogen, halogen, an alkyl group or an aryl group; $R^5$ is —OH,

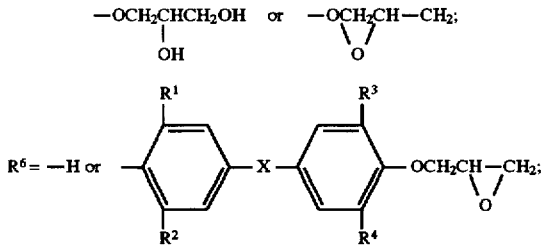

each of $R^7$ and $R^8$ (same or different) represents hydrogen, an alkyl group, an aryl group or represents the necessary atoms to complete, together with the carbon atom to which they are attached, a cycloaliphatic ring, and n is zero or an integer, and said resin (2) before its crosslinking is an epoxy resin that has undergone a reaction with a dialkanolamine, wherein the ratio of total free hydroxy-groups in said resin(s) according to formula (I) and/or said epoxy resin(s) that has undergone a reaction with a dialkanolamine, expressed as hydroxy-equivalents, to the total isocyanate equivalents in said polyisocyanates is in the range 3.0:1 to 1:2.0.

* * * * *